US010458152B2

(12) United States Patent
Schort et al.

(10) Patent No.: US 10,458,152 B2
(45) Date of Patent: Oct. 29, 2019

(54) GATE ASSEMBLY EMPLOYING A DUAL ACTUATOR LATCHING MECHANISM

(71) Applicant: Proofed, Inc., Lafayette, CA (US)

(72) Inventors: Amanda Schort, Lafayette, CA (US); Christopher Hamlin, Seattle, WA (US); Robert Carrasca, Seattle, WA (US); James John Wojcik, Kirkland, WA (US)

(73) Assignee: PROOFED, INC., Lafayette, CA (US)

( * ) Notice: Subject to any disclaimer, the term of this patent is extended or adjusted under 35 U.S.C. 154(b) by 252 days.

(21) Appl. No.: 15/594,178

(22) Filed: May 12, 2017

(65) Prior Publication Data

US 2017/0350165 A1 Dec. 7, 2017

Related U.S. Application Data

(60) Provisional application No. 62/346,057, filed on Jun. 6, 2016.

(51) Int. Cl.

| | |
|---|---|
| ***E05B 65/00*** | (2006.01) |
| ***E05B 47/00*** | (2006.01) |
| ***E05C 3/16*** | (2006.01) |
| ***E06B 9/00*** | (2006.01) |
| ***E05B 47/06*** | (2006.01) |

(52) U.S. Cl.

CPC ..... *E05B 65/0007* (2013.01); *E05B 47/0012* (2013.01); *E05B 47/0603* (2013.01); *E05B 65/0014* (2013.01); *E05C 3/16* (2013.01); *E06B 9/00* (2013.01); *E05B 2047/0023* (2013.01); *E05B 2047/0068* (2013.01); *E06B 2009/002* (2013.01)

(58) Field of Classification Search

CPC ..... E06B 9/00; E06B 2009/002

See application file for complete search history.

(56) References Cited

U.S. PATENT DOCUMENTS

| | | | | |
|---|---|---|---|---|
| 4,083,591 | A * | 4/1978 | Parisien | E05B 65/06 292/202 |
| 4,702,036 | A | 10/1987 | Johnson | |
| 4,831,777 | A | 5/1989 | Johnson, Jr. | |
| 5,638,885 | A | 6/1997 | Freese et al. | |
| 5,729,198 | A | 3/1998 | Gorman | |
| 5,797,218 | A | 8/1998 | Holland | |
| 5,924,242 | A | 7/1999 | Macari et al. | |
| 6,112,460 | A | 9/2000 | Wagnitz | |

(Continued)

FOREIGN PATENT DOCUMENTS

| | | | | |
|---|---|---|---|---|
| DE | 20117887 U1 | | 5/2002 | |
| GB | 2402168 A | * | 12/2004 | E05F 1/1215 |

(Continued)

*Primary Examiner* — Catherine A Kelly

(74) *Attorney, Agent, or Firm* — Perry Hoffman

(57) ABSTRACT

A gate assembly including a pivoting gate element secured to a doorway and/or passageway and employing a dual actuator latching mechanism having a simple yet unique locking lever and pawl mechanism for remote and manual latch release freeing the gate to swing to an open position, and automatic re-locking of the latching mechanism. The gate assembly includes a frame element for supporting the pivoting gate element and securing the gate to a doorway and/or passageway as well as latching the gate to a closed position at the frame element.

20 Claims, 9 Drawing Sheets

(56) References Cited

U.S. PATENT DOCUMENTS 6,253,490 B1 7/2001 Postans
6,711,857 B1 * 3/2004 Wagnitz ..... E05B 47/0002 49/394
7,065,922 B1 * 6/2006 De Kruijf ..... E05B 65/0014 292/212
7,131,235 B2 11/2006 Hicks
7,178,792 B2 * 2/2007 Monahan ..... E06B 9/08 160/10
7,334,624 B2 2/2008 Waldman et al.
7,373,755 B2 5/2008 Jefferys et al.
7,481,471 B2 * 1/2009 Andersen ..... E05B 47/0046 292/251.5
8,205,388 B2 * 6/2012 Yates ..... E05B 65/0014 49/394
8,267,244 B2 9/2012 Dunn et al.
8,297,336 B2 10/2012 Yates
8,341,886 B2 1/2013 Yates
8,468,743 B2 * 6/2013 Ting ..... E05B 47/026 160/180
8,578,656 B2 11/2013 Yates et al.
8,615,931 B2 12/2013 Dunn
8,733,017 B2 * 5/2014 Marsden ..... E05B 41/00 49/333
8,863,811 B2 10/2014 Yates et al.
8,875,444 B2 11/2014 Dunn
9,051,770 B2 6/2015 Yates et al.
9,097,050 B2 8/2015 Yates
9,151,108 B1 10/2015 Flannery et al.
9,388,603 B2 * 7/2016 Flannery ..... E05B 1/0053
9,637,959 B2 * 5/2017 Marsden ..... E05C 19/003
2002/0196123 A1 12/2002 Diehl et al.
2004/0045222 A1 3/2004 Hicks
2006/0081826 A1 * 4/2006 Cheng ..... E06B 9/04 256/22
2006/0175028 A1 8/2006 Askinasi
2009/0151258 A1 * 6/2009 Andersen ..... E05B 53/001 49/281
2010/0293861 A1 * 11/2010 Ting ..... E05B 47/026 49/394
2011/0067309 A1 * 3/2011 Hofmann ..... E06B 9/04 49/55
2012/0255234 A1 * 10/2012 Wang ..... E05B 65/0007 49/395
2014/0007506 A1 * 1/2014 Huang ..... E06B 3/32 49/149
2014/0318018 A1 * 10/2014 Huang ..... E05C 3/12 49/386
2015/0101250 A1 * 4/2015 Marsden ..... E06B 9/0623 49/55
2017/0073998 A1 * 3/2017 Fang ..... E05B 65/0007

FOREIGN PATENT DOCUMENTS

WO 2003003192 A1 1/2003
WO 2014176619 A1 11/2014

* cited by examiner

GATE ASSEMBLY EMPLOYING A DUAL ACTUATOR LATCHING MECHANISM

PRIORITY CROSS-REFERENCE TO RELATED APPLICATION

This application claims priority pursuant to 35 U.S.C. 119(e) from U.S. Provisional Patent Application No. 62/346,057, filed on Jun. 6, 2016.

BACKGROUND OF THE INVENTION

1. Field of the Invention

The present invention relates to safety gates and more particularly to a gate assembly employing a dual actuator latching mechanism for remote and manual latch release and automatic re-locking having a simple yet unique locking lever and pawl mechanism.

2. Background of the Invention

Safety and/or security gates secured to a doorway and/or passageway for preventing young children and pets from passing through are known and seen to include various mechanisms for latching and unlatching a gate element. Most safety gates include a frame assembly for securing the gate to a doorway or passageway opening either frictionally, employing a tension mechanism, or more permanently, by mounting the frame on the doorway/passageway with hardware such as nuts, screws and small bolts, etc. The gate element is secured to the frame and latched closed or unlatched to swing open allowing passage through the doorway/passageway in either one or both directions.

Many known latching mechanism are secured to the gate and/or frame assembly preventing the gate from swinging open, as desired by a user. Known latching mechanisms are unlatched manually or remotely and are actuated in either a complicated way, or in a way that requires significant dexterity and/or strength to unlatch the mechanisms. Known safely gates are not designed to actuate a latching mechanism both manually and remotely with a simple yet unique locking lever and pawl mechanism. Known latching mechanisms do not employ a manual handle which elevates a lever, freeing the lever from capture between matching pawls to unlatch the gate, and also remotely signal a locking block to shift so the matching pawls swing freely to release the captured lever and also unlatch the gate. Additionally, known latching mechanisms do not automatically re-lock after a user has passed through subsequent to manual and remote unlatching.

There is a known latching mechanism which employs a remote actuator exemplified and disclosed in U.S. Pat. No. 6,711,857, issued Mar. 30, 2004 to Wagnitz, etal. A rotating cam is mounted about a center rod and having a generally "U"-shaped slot for defining a space in which to receive a locking pin therein. A solenoid and coupled locking arm prevent the cam from rotating about the locking pin in a latched position and retract to allow rotation of the cam in an unlatched position. The latch mechanism is disposed at the safety gate and a remote actuator is positioned away from the gate sending a signal to a receiver in the latch mechanism to retract the solenoid and locking arm allowing the cam to rotate about the locking pin and unlatch the safety gate. Wagnitz does not teach or disclose a latching mechanism with any manually unlatching elements nor does Wagnitz teach or disclose a locking lever and matching pawls mechanism.

Other known remotely actuated latching mechanisms may include a magnetic locking device having a magnet disposed at an end of a channel in the frame and a rod disposed at the gate and residing in the channel at the magnet when in a locked position and vertically displaced from the channel and magnet, either remotely or manually, in an unlocked position. It is also known to employ a wireless remote to unlock a cabinet door by adhering a receiver to a cabinet locking mechanism.

There is a known latching mechanism manually actuated by a handle as exemplified and disclosed in U.S. Pat. No. 8,205,388, issued Jun. 26, 2012 to Yates. A handle having an outer housing is slidably mounted on an inner housing with a latch arm pivotably mounted on the inner housing of the handle. The arm is spring biased to a latched position where the arm is pivoted into a recess in the handle housing or a frame preventing the gate from swinging open. Lower arms are pivotably mounted to the outer housing and biased toward each other and engaging a protruding lip on the inner housing preventing downward movement of the outer housing relative to the inner housing.

Depressible buttons are provided on opposite side walls of the outer housing and joined to the lower arms. Inward depressing of the buttons moves lower arms from engagement with the protruding lips allowing the outer housing to move downwardly. Simultaneous or subsequent downward sliding of the outer housing with respect to the inner housing moves a lower end of the handle to actuate the latch arm with a downward force pivoting the arm into an unlatched position and out from the recess in the handle allowing the gate to swing open. Yates does not teach of disclose a latching mechanism with any remote unlatching elements nor does Yates teach or disclose a locking lever and matching pawls mechanism.

Other known manually actuated latching mechanisms include a latching mechanism with two possible pathways for a latch pin to travel. One pathway captures the latch pin in a latch slot for locking the mechanism and lifting the gate and latch pin along an alternative pathway will release the pin from the latch slot and release the mechanism opening the gate along a movement too complicated for a young child. Also known is a removably received hinge bracket on hardware mounted on a gate. Two panels slide in a horizontal track to open the gate. Also known is a gate with a pivoted latch. A U shaped keeper member captures the frame to lock the gate and planer latch disposed at the gate engages a notch in the keeper to lock the gate when the gate is swung closed. Various other latching mechanisms are known employing pull up or push down handle's which pull or release a pin from a recess to a dual actuator latching mechanism for remote and manual latch release including a simple yet unique locking lever and pawl mechanism.

Significantly, known safety gates do not teach or disclose a gate assembly employing a dual actuator latching mechanism for remote and manual latch release and automatic relocking having a simple yet unique locking lever and pawl mechanism. It would be desirable to provide a pivoting gate element with an affixed pivoting lever coupled to a manual release handle and adjacent two matching pawls. The matching pawls capture the lever to latch the gate and the release handle is manually shifted to release the lever and unlatch the gate. Additionally, a remote actuator is in wireless communication with a motor, or solenoid or the like and a screw or piston driven locking block is disposed adjacent the pawls. The remote actuator signals the motor to drive the block between the pawls to lock the captured lever and latch the gate, and to also drive the block away from the pawls to release the captured lever and unlatch the gate.

SUMMARY OF THE INVENTION

The present invention addresses shortcomings of the prior art to provide a safety gate apparatus which simply yet uniquely latches and unlatches a gate element in both a manual and remote mode. The safety gate employs a pivoting locking lever and a matching pawl mechanism coupled to a release handle to shift the locking lever from between the matching pawls to manually unlatch the gate, and the matching pawls are in communication with a motor and locking block to remotely drive the block away from the matching pawls to release the locking lever from between the matching pawls to remotely unlatch the gate.

In one embodiment of the present invention a safety gate assembly includes a pivoting gate element with a secured end and an open end, pivoting at the secured end between an open and a closed position. A pivoting lever is disposed at the open end of the gate and includes a first end and second end. Two matching pawls are disposed adjacent the pivoting lever and the pawls include a pivot end and a free end. The pawls pivot away from and toward each other capturing the pivoting lever between the pawls at the free end to latch the pivoting gate in the closed position.

A screw (or piston) driven locking block is disposed adjacent the pawls at the pivot end and a driving mechanism (actuator) is in mechanical communication with the block driving the block back and forth and into a locking position when the block is driven between the pawls at the pivot end preventing the pawls from pivoting away from each other at the free end latching the pivoting lever between the pawls. A remote actuator is in wireless communication with the motor, driving the block away from the pivot ends of the pawls allowing the pawls to pivot away from each other at the free end releasing the pivoting lever from between the pawls to unlatch the gate to the open position. A manual actuator leg is disposed adjacent the second end of the lever and a manual release handle is coupled to the actuator leg. A manual upward force of the handle elevates the second end of the lever releasing the first end of the lever from between the pawls to unlatch the gate to the open position.

In another embodiment, a biasing element is disposed adjacent the pair of pawls biasing the free end of the pawls to pivot toward each other and each of the pair of pawls includes an angled surface for directing the lever into a position between the biased pawls when the gate assembly is pivoted toward the closed position in a slamming fashion.

In another embodiment, a spring element is coupled to the pivoting lever for biasing the first end of the lever to a captured position between the free ends of the two matching pawls. In another embodiment, the manual release handle unlatches the gate element through a lateral force shifting the handle toward the secured end of the gate followed by vertical upward force shifting the handle away from the gate.

In yet another embodiment, a frame assembly including right and left L shaped elements secured together and forming a u shaped frame assembly supports the gate element there between. In another embodiment, a first and second swivel hinge spaced apart from one another and coupled to the frame assembly at first and second attachment points, couple the secured end of the gate element to the frame assembly, each swivel hinge includes at least one gliding surface that pivots about the attachment point at the frame swinging the gate out away from the frame as the gate pivots to the open position. In still yet another embodiment, the safety gate assembly further includes active electronics adjacent the driving mechanism (actuator) and the gate element for sensing and processing the open and closed position of the gate.

BRIEF DESCRIPTION OF THE DRAWINGS

For the purpose of facilitating an understanding of the inventions, the accompanying drawings and description illustrate a preferred embodiment thereof, from which the inventions, structures, construction and operation, and many related advantages may be readily understood and appreciated. The invention advantages may be best understood from the following detailed description taken in conjunction with the drawing figures, in which:

FIG. 4A is illustrating a pivoting lever of the latching mechanism in a generally horizontal and latched position; while

FIG. 5A is illustrating a pawls housing with extended matching pawls, while

FIG. 10A is illustrating a swivel hinge at a first attachment point on the frame element, while

DETAILED DESCRIPTION OF THE EMBODIMENTS

The following description is provided to enable those skilled in the art to make and use the described embodiments set forth in the best modes contemplated for carrying out the invention. Various modifications, however, will remain readily apparent to those skilled in the art. Any and all such modifications, equivalents, and alternatives are intended to fall within the spirit and scope of the present invention.

Figure 1A:
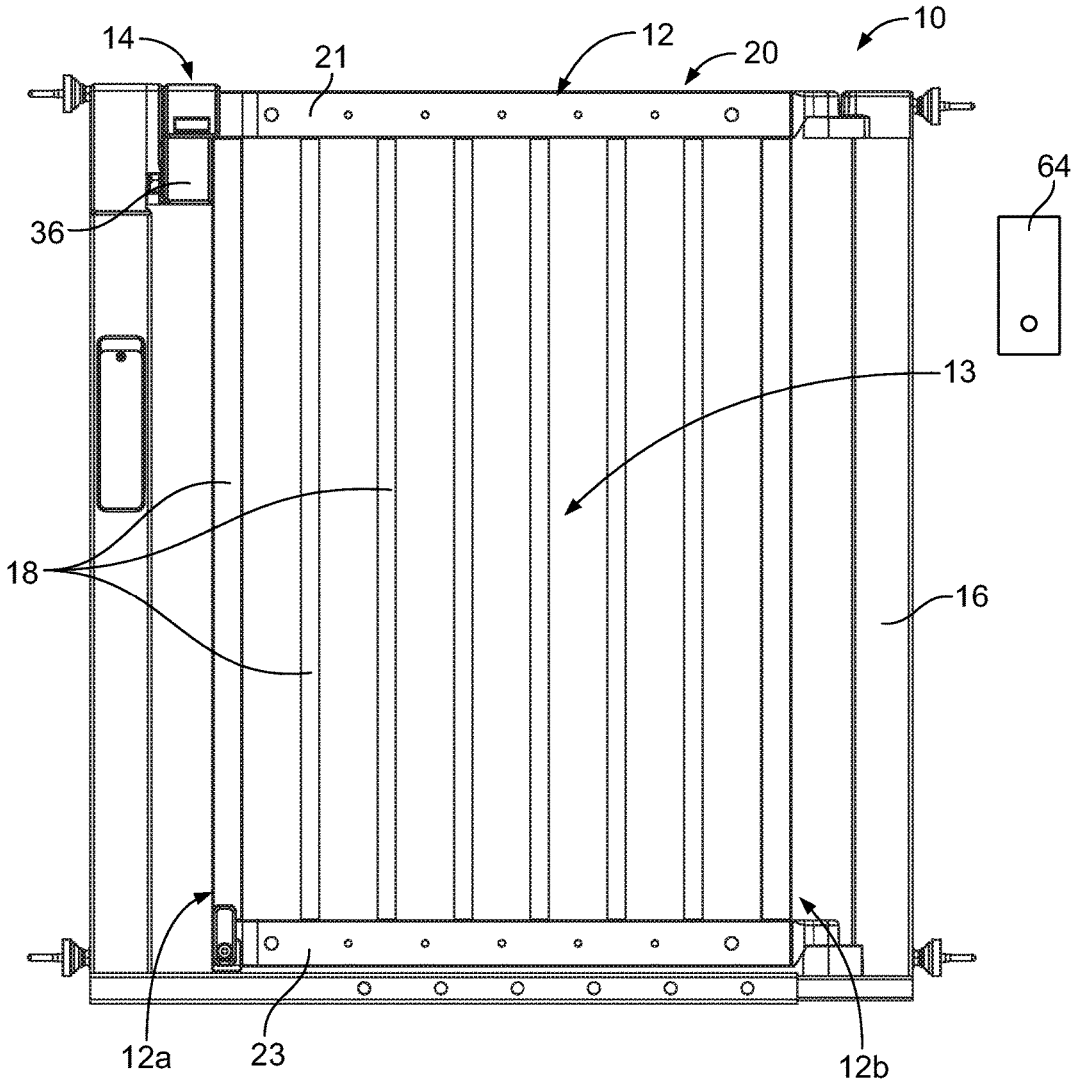
FIG. 1A is a safety gate assembly of the present invention illustrating a gate element coupled to a frame element, with FIG. 1B illustrating the frame element expanded in width.

A gate assembly 10, as seen in FIG. 1A, is generally seen to include a pivoting gate element 12 secured to a doorway and/or passageway and employing a dual actuator latching mechanism 14 for simple yet unique remote and manual latch release, freeing the gate to swing to an open position, and automatic re-lock when the gate swings back to the closed position. In the present described embodiment, the gate assembly most reliably re-locks automatically if the gate is first swung open to 45 degrees or more before the gate is slammed closed. Additionally, the gate assembly 10, includes a frame element 16 for supporting the pivoting gate element 12 and securing the gate to a doorway and/or passageway as well as latching the gate to a closed position at the frame element.

The gate element 12, as seen in FIG. 1A, includes an open end 12*a* and a secured end 12*b* and pivots at the secured end between an open and a closed gate position. The gate element is manufactured from a premium expandable hardwood and includes parallel vertical bars 18 coupled to horizontal supports 20, which are perpendicular to the vertical bars. It is contemplated that some or all of the gate element 12 is manufactured from a variety of materials including metal, plastic and other wood varieties that are suitable for forming the vertical bars 18 and horizontal supports 20.

Figure 2:
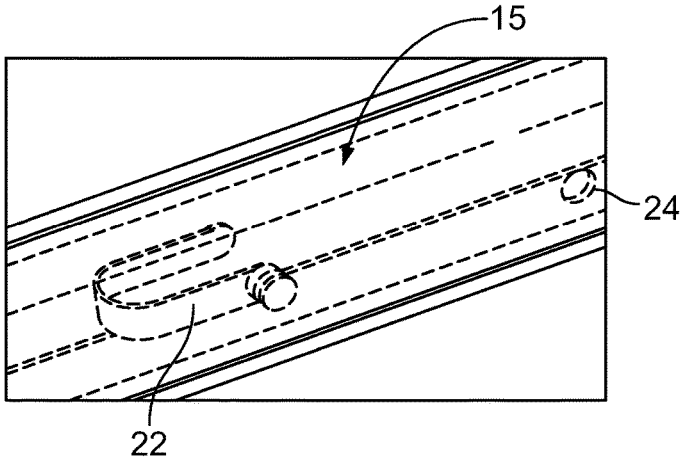
FIG. 2 is illustrating a pinch button inserted into a predetermined hole in a horizontal frame member of the gate element.

In the present described embodiment, the gate element 12 includes generally identical first and second gate panels. The gate panels are disposed adjacent each other such that the vertical bars 18 of each first and second panel lines up parallel with each other and the horizontal supports 20 of each first and second panel lines up parallel with each other. As seen in FIG. 1A, a first panel 13 includes a first top horizontal support 21 and a first bottom horizontal support 23, and a plurality of parallel vertical bars 18 are coupled between first and second horizontal supports. Likewise, second panel 15 includes a second top horizontal support and a second bottom horizontal support (as seen in FIG. 2) coupling a plurality of parallel vertical bars 18 in between. The second panel is directly adjacent and lines up exactly with and behind the first panel and cannot be seen in FIG. 1A.

First and second gate panels telescope out or slide apart from one another to expand the width of the gate element. In the present described embodiment, the top horizontal supports, of the first and second panels and the bottom horizontal supports, of the first and second panels are positioned adjacent one another and slide back and forth along each other to position the two panels of the gate element to a desired width. Pinch buttons 22, as seen in FIG. 2, pop into predetermined holes or slots 24 in the horizontal supports 20 of horizontal frame members for each panel in order to secure the left and right frame members to a desired frame width for the horizontal supports to one another once the two panel are positioned to the desired gate width. As seen in FIG. 2, a pinch button 22 is inserted into a horizontal slot of a bottom horizontal support of second panel 15. In the present described embodiment, a single sided pinch button secures the horizontal supports of each panel to one another to achieve a desired gate element 12 width which expands between 20.75 inches to 33.0 inches.

In use, a single push button is depressed by the user enabling the user to slide the panels of the gate element to a wider or narrower gate disposition to reveal a next predetermined hole or slot. The single button will pop into this next hole or slot, and if the desired width has been achieved, the single button received into the slot will prevent future movement of the panels of the gate element, securing the panels together at this new desired width. If an alternative gate element width is desired, the user will simply depress the single button again and position the button into any of the predetermined slots available on the panels of the gate element until the desired width is achieved.

The frame element 16 supports the pivoting gate element 12 securing the gate to a doorway and/or passageway. The frame element is coupled to the gate at the secured end 12*b* of the gate element and the free end 12*a* of the gate is latched to the frame element. The secured end of the gate element pivots between an open position when the latch is released and a closed position when the latch is locked.

Figure 1B:
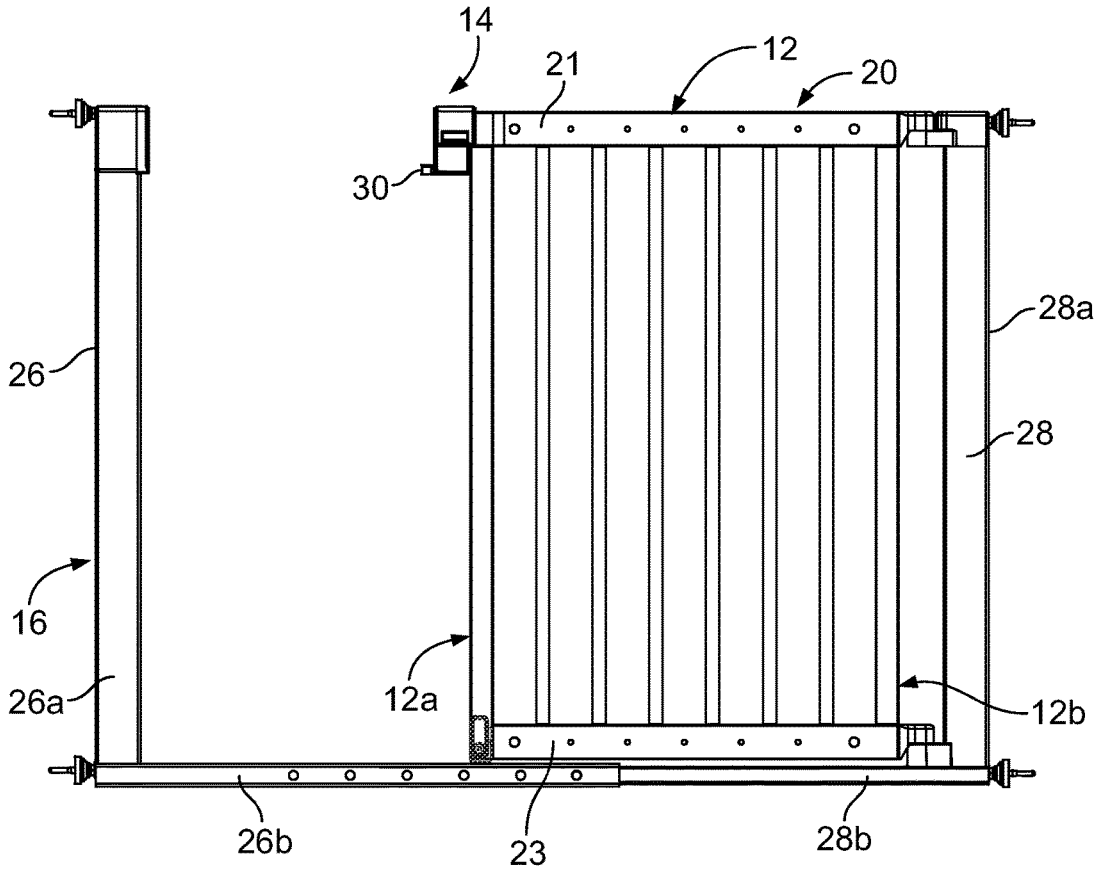

The frame element 16 is generally seen to be U shaped, as seen in FIG. 1B, and includes left and right frame portions 26 and 28, respectively. Each frame portion, 26 and 28, is generally L shaped with a vertical member, 26*a* and 28*a*, respectively, and a horizontal member, 26*b* and 28*b*, respectively. In the present described embodiment, at least a portion of left horizontal frame member 26*b* is generally hollow and captures right horizontal frame member 28*b* within, in a telescoping fashion. Right horizontal frame member 28*b* has a slightly smaller cross sectional thickness than left horizontal frame member 26*b* to allow for easy sliding movement of right member 28*b* in and out of left frame member 26*b*, allowing the width of the frame element 16 to be expanded as desired by the user.

In the present described embodiment, left and right frame portions, 26 and 28, respectively, are manufactured from steel providing a sturdy support on which to mount gate element 12. It is also contemplated that the frame portions can be manufactured from other suitable materials such as heavy duty plastic or wood and that alternatively, the horizontal frame members 26*b* and 28*b* can be positioned adjacent one another and slide along each other to expand the width of the frame element. Pinch buttons 22, as seen in FIG. 2, pop into predetermined holes or slots 24 in each of left and right horizontal frame members in order to secure the left and right frame members to a desired frame width. In the present described embodiment, a single sided pinch button secures the frame elements to one another to achieve a desired frame width which expands to fit within a variety of doorway and/or passageway opening, as seen in FIG. 1B, especially within most common openings between 28.75 inches to 44 inches.

In use, as with the gate element, a single push button is depressed by the user enabling the user to slide the frame elements to a wider or narrower frame disposition revealing a next predetermined hole or slot. The single button will pop into this next hole or slot, and if the desired width has been achieved, the single button received into the slot will prevent future movement of the frame element 16, securing the left and right horizontal frame portions at this new desired width. If an alternative frame element width is desired, the user will simply depress the single button again and reposition the button into any of the predetermined slots available on the horizontal frame portions of the frame element until the desired width is achieved.

Figure 3:
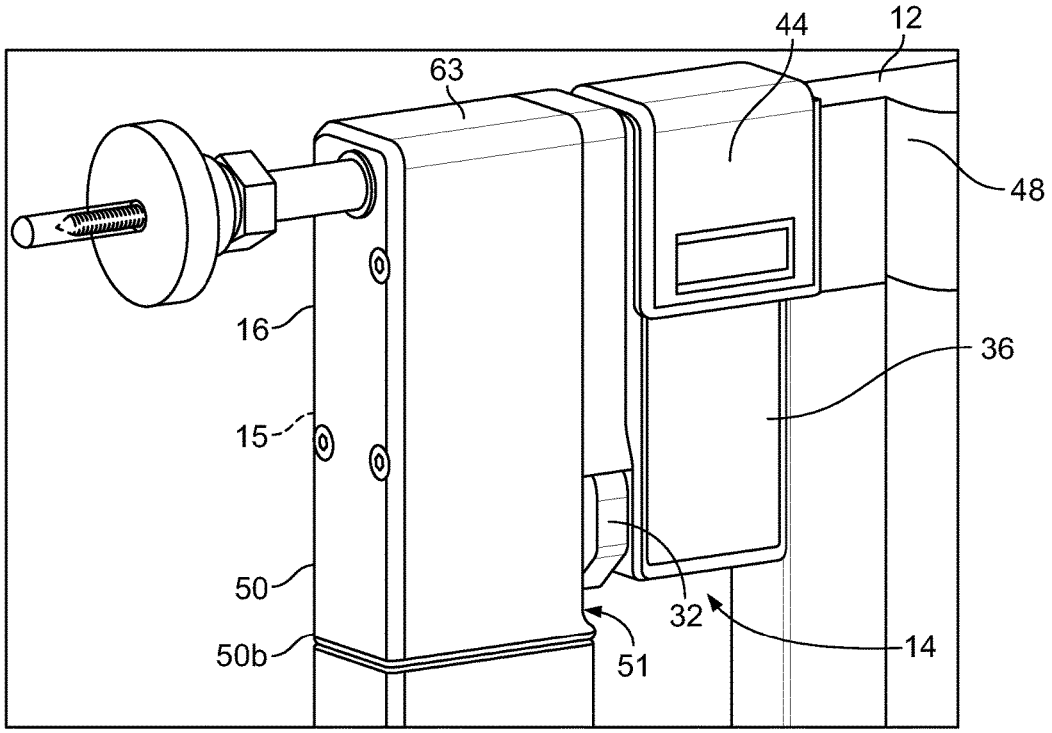
FIG. 3 is illustrating a latching mechanism coupled between the gate element and the frame element and including a manual release handle.

A dual actuator latching mechanism 14 is disposed at the open end of the gate element, as seen in FIG. 1B, and in the present described embodiment, the dual actuator latching mechanism is disposed between the gate element and the frame element, as seen in FIG. 3. The dual actuator latching mechanism 14 includes a pivoting lever 30 and at least one pawl 32, as seen in FIGS. 1B and 3, defining a simple yet unique latching mechanism for remote and manual latch release of the gate element as well as automatic relock of the latching mechanism. The latching mechanism most reliably relocks the gate element automatically, if the gate element is swung open at least 45 degrees before swinging shut.

Figure 4A:
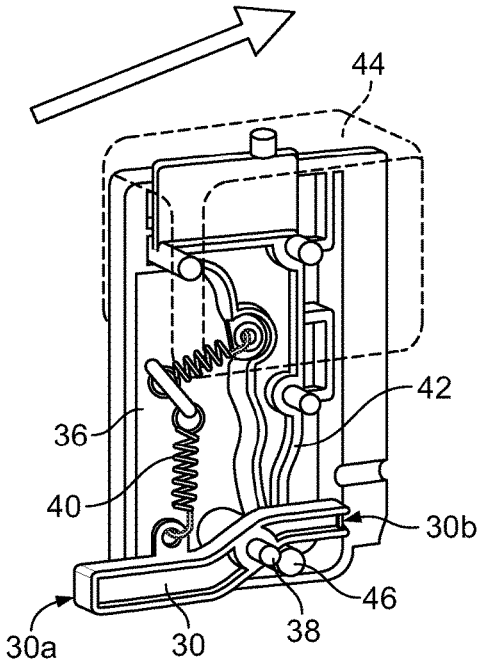
Figure 4B:
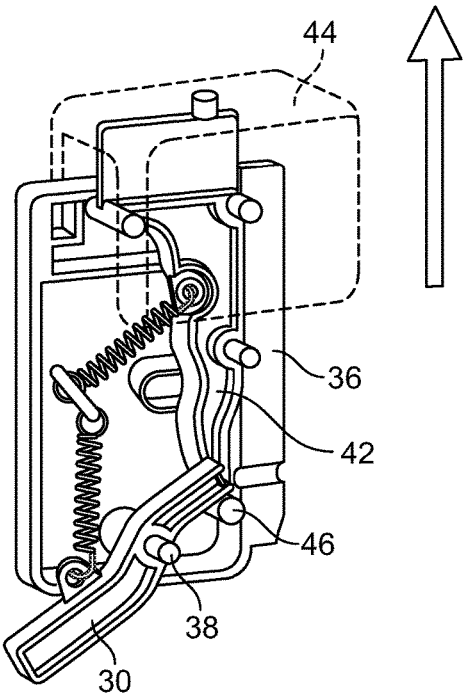
FIG. 4B is illustrating the pivoting lever shifted to an unlatched position.

The pivoting lever 30 is disposed at the open end 12*a* of the gate element and includes a first end 30*a* and second end 30*b*, as seen in FIGS. 1B and 4A & 4B. At least one pawl 32 is disposed adjacent the pivoting lever 30 and, in a present described embodiment, two matching pawls, 32 and 34, respectively, are disposed adjacent the pivoting lever. The two matching pawls, as seen in FIG. 5, include a pivot or first end, 32*a* and 34*a*, respectively, and a free or second end, 32*b* and 34*b*, respectively. The two matching pawls pivot away from and toward each other capturing the pivoting lever 30 between the pawls at the free end to latch the pivoting gate in the closed position.

The dual actuator latching mechanism 14 includes a lever housing 36 affixed to the open end 12*a* of the gate element adjacent the first top horizontal support 21. The lever 30 pivots about a pin 38 affixed to the lever housing 36, as seen in FIGS. 4A & 4B. The first end 30*a* of lever 30 is captured between the two matching pawls 32 and 34, when the lever 30 is in a generally horizontal upright position, as seen in FIG. 4A, latching the pivoting gate in the closed position. A spring 40 is coupled to the lever housing 36 at one end and to the lever 30 at an opposite end for biasing the first end 30*a* of the lever 30 to the captured position and in a generally horizontal upright position, as seen in FIG. 4A.

The lever housing 36 further includes a manual actuator leg 42 disposed adjacent the second end 30*b* of the lever 30 and a manual release handle 44 coupled to the actuator leg, as seen in FIGS. 3 and 4A & 4B. A manual upward force of the handle by a user elevates the second end 30*b* of the lever releasing the first end 30*a* of the lever from between the pawls 32 and 34, to unlatch the gate to the open position. In the present described embodiment, the actuator leg 42 includes a contacting peg 46 protruding from the leg for providing a secure contacting surface on which to pivot the lever 30 to the unlatched position, as seen in FIG. 4B.

Additionally, a manual lateral force applied to the manual release handle 44, shifts the handle toward the gate element, and in the present described embodiment, the lateral force is applied to the handle before the upward force is applied to the handle shifting the manual actuator leg 42 and protruding peg 46 closer to the second end 30*b* of the lever, for quick and reliable pivoting of the lever and thus release of the lever from between the pawls. The release handle 44 includes a finger slot 48 cut into an exterior surface of the manual actuator handle for easier gripping and application of the lateral and upward forces on the handle by the user.

The simple intuitive 2-step L motion, namely the lateral than upward force, releases the latch in a manual override mode when either the remote latch release is not operable, such as if a battery dies and cannot drive the motor, or if desired by the user for any reason. This simple motion of the manual release handle is ergonomically hard for small children to operate, especially those younger than 2 years old, preventing young children from manually releasing the latching mechanism, creating a safety gate not operable by young children.

The dual actuator latching mechanism 14 further includes a pawl housing 50 disposed at the frame element 16 and adjacent the lever housing 36 when the gate element is latched and in the closed position as seen in FIGS. 1A and 3. The pawl housing has a generally low profile so as not to interfere with the user moving through the doorway and/or passageway when the gate element is unlatched and in the open position. Additionally, a notch 51 can be cut out of the frame element to further remove the affixed pawl housing 50 from the opening by which the user will pass through when the gate element is unlatched and in the open position.

The pawl housing 50 includes a first end 50*a* and a second end 50*b*, as seen in FIGS. 3 and 5, and the two matching pawls, 32 and 34, are disposed at and protrude from the second end of the housing. The pawls 32 and 34, respectively, are pivotably coupled/mounted to the pawl housing 50 at pins 52 and 54, respectively. In the present described embodiment, the pawls 32 and 34 are pivotably mounted at their pivot or first ends, 32*a* and 34*a*, respectively, on pins 52 and 54, respectively, with free or second ends 32*b* and 34*b*, respectively, generally extending from the pawl housing 50 to a position capable of capturing the first end of the pivoting lever 30 to latch the gate 12.

Figure 5B:
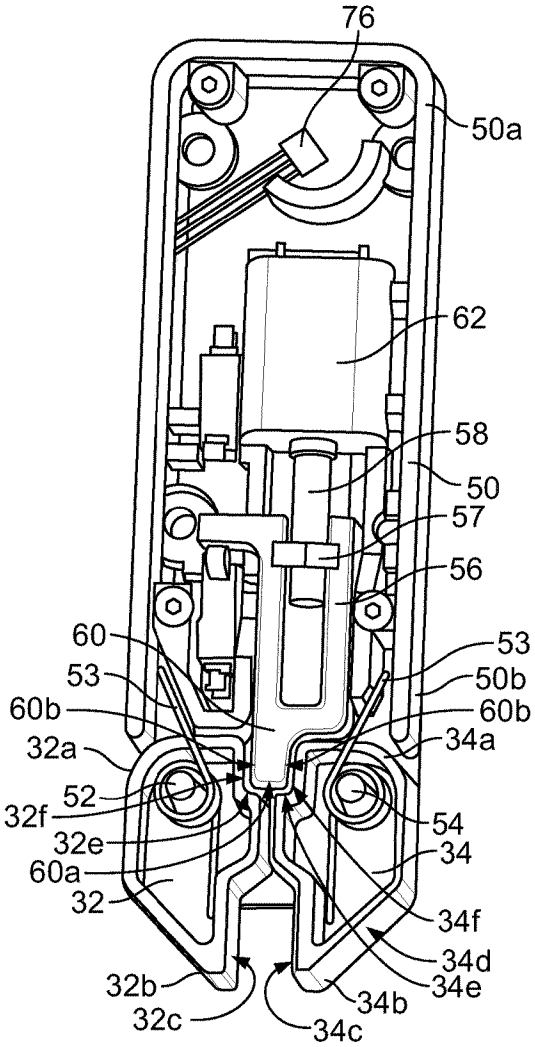
FIG. 5B is illustrating the pawls pivotably mounted to the housing and adjacent a screw driven locking block and wirelessly controlled driving mechanism.

A biasing element, as seen in FIG. 5B, is disposed adjacent the pair of pawls biasing the free ends of the pawls to pivot toward each other. In the present described embodiment, a torsion springs 53 are coupled to the pawl housing 50 and to each pawl 32 and 34, biasing the free ends of the pawls toward each other for secure capture of the pivoting lever and for urging the pawls toward each other when the locking block is not engaged such as after the pawls have been pushed apart by a user to open the gate element which has been remotely unlatched, as discussed in more detail below.

The pawls 32 and 34, at their free or second ends, 32*b* and 34*b*, respectively, are generally triangular in shape and include a generally perpendicular upright surface 32*c* and 34*c*, respectively. The generally perpendicular surfaces 32*c* and 34*c* face each other and define a space in between in which the first end of the lever is securely captured to lock the latching mechanism. Pawls 32 and 34 also include an angled surface, 32*d* and 34*d*, respectively, diagonal to the perpendicular surfaces, 32*c* and 34*c*. The angled surfaces 32*d* and 34*d* direct the pivoting lever into a captured position between the biased pawls when the gate assembly is pivoted toward the closed position in a slamming fashion.

A screw (or piston) driven block 56, as seen in FIG. 5B, is contained within the pawl housing and is disposed adjacent the pivot ends of the pawls 32 and 34. The block 56 is generally rectangular in shape and travels back and forth along a screw 58 which is retained by the pawl housing. A nut 57 is captured within the block and travels up and down the screw 58. Alternatively, a piston can shift the block 56 back and forth within the pawl housing.

The block 56 includes a tapered tip 60, which is designed to fit between the pivoting ends of both pawls and a horizontal locking surfaces 60*a* and two vertical locking surfaces 60*b* that engage the pawls when the block has traveled to a position in contact with the pawls for locking the latching mechanism. Correspondingly, pawls 32 and 34 include locking surfaces at the pivoting ends, and in the present described embodiment, the pawls each have a horizontal locking surface, 32*e* and 34*e*, respectively, and a vertical locking surface, 32*f* and 34*f*, respectively.

A driving mechanism (actuator) 62 is in mechanical communication with the block 56 and contained within the pawl housing 50. The driving mechanism (actuator) can include a motor, an actuator, a gear driven solenoid, or the like. In the present described embodiment, a motor, gear assembly, and a threaded shaft (screw) 62. The motor rotates the threaded shaft (screw) 58 which communicates with the nut 57 captured within the block 56 to drive the block back and forth between a pawl locking position and a pawl unlocking position.

In an alternative presently described embodiment, the driving mechanism 62 includes a solenoid system, having a solenoid and gear box, for driving the block 56 back and forth between the pawl locking position and the pawl unlocking position. The solenoid includes a magnetically charged core operating a piston (or screw) for positioning the block 56. The solenoid is energized in a typical manner, energizing the piston to extend and position the block 56 in the locking position.

In the locking position the block is driven between the pawls at the pivot end preventing the pawls from pivoting away from each other at the free ends and latching the pivoting lever between the pawls. In the present described embodiment, the block horizontal locking surface 60*a* is driven into contact with pawl horizontal locking surfaces 32*e* & 34*e*, respectively, and, block vertical locking surfaces 60*b* is driven into contact with pawl vertical locking surfaces 32*f* & 34*f*, respectively, securing pawls 32 and 34 in a locking position and unable to pivot away from each other.

The driving mechanism 62 (whether the motor, solenoid system, or the like) is small enough to be retained by the pawl housing 50 and in the present described embodiment is battery powered, e.g., using 4 AA batteries with a battery life of about 6+ months. The motor is wirelessly activated and utilizes low energy as disclosed, but of course may be wired for activation alternatively. The mechanical sound of the motor provides simple feedback to the user for determining when the gate element 12 is unlocked. Additionally, a simple LED is disposed at the latching mechanism 14 to provide simple visual feedback to the user to indicate that the gate is unlatch. In the present described embodiment, the LED is disposed at the frame element, as seen in FIG. 3, and can exhibit a color or a variety of colors to alert the user as to when the gate element is unlocked, for example the LED is green, or locked, or if the motor battery has low life. However, in the alternative the mechanical sound of the motor or an audible sound may be provided with a speaker, piezo or the like, and indicators and operations may be provided with a further device such as a mobile device like a phone or smart watch; the LED indicator may be otherwise represented, shown or communicated with a smart device, watch, tablet, mobile or phone which may be employed further as a remote control, and may be voice activated e.g. through devices such as Apple™ Siri or Amazon™ Alexa.

A remote actuator 64 is in wireless communication with the driving mechanism 62, signaling the driving mechanism to drive the block back and forth along the screw 58 (or piston) to both release the latching mechanism unlocking the gate element and allowing the gate to swing open, and also to automatically re-lock the latching mechanism to capture the gate element when it is swung to a closed position. Also, the remote actuator wirelessly signals the driving mechanism to drive the block away from the pivot ends of the pawls allowing the pawls to pivot away from each other at the pawl free ends releasing the pivoting lever from between the pawls to unlatch the gate to the open position. In the present described embodiment, the remote actuator includes a radio to sense gate positioning and a simple push button 65 activated to signal the driving mechanism 62 through wireless communication to unlatch the gate with an easy single touch of the remote.

Figure 7:
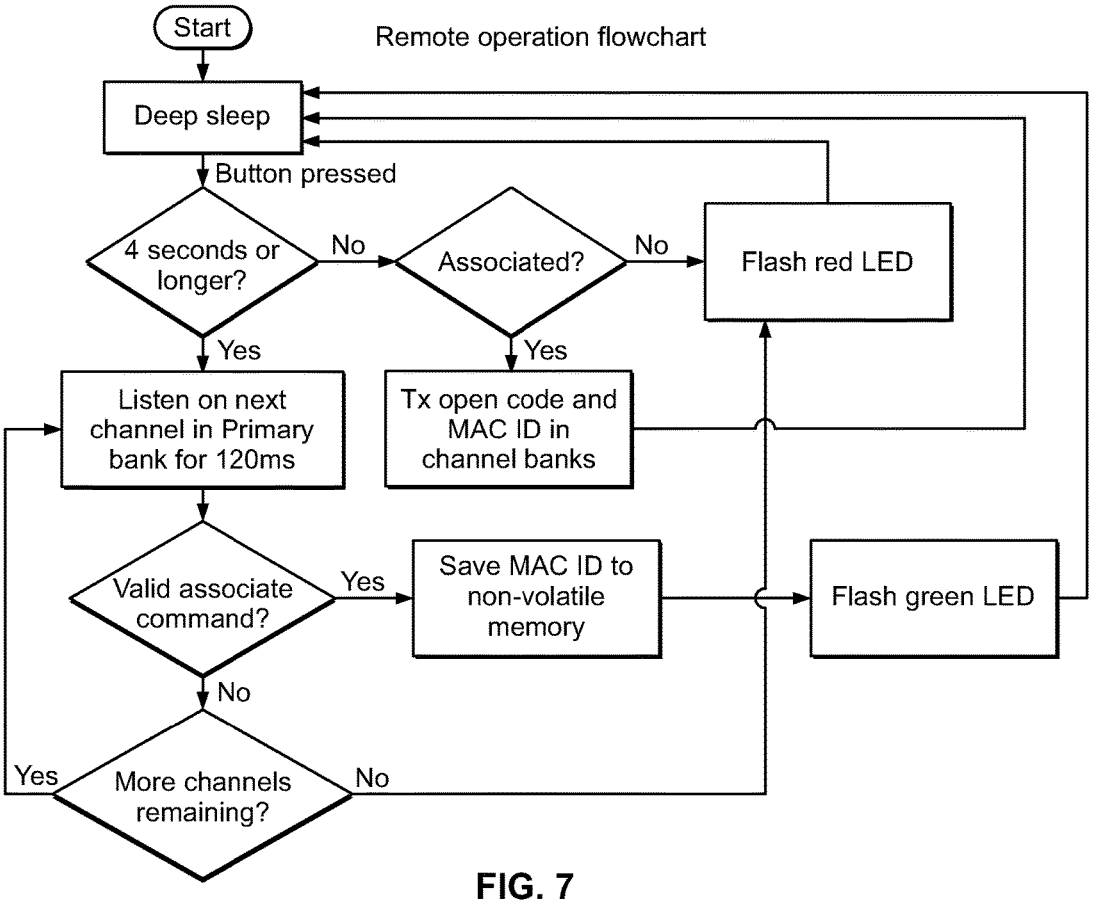
FIG. 7 is a schematic flow chart illustrating the steps of remotely operating the latching mechanism of the present invention.

Many types of wireless communication between the hardware of the latching mechanism including RF communication, etc. can be employed, however, in the present described embodiment, Bluetooth LE technology wirelessly communicates between the remote controller and the latching mechanism coupled to and adjacent the gate element, as seen in FIG. 7. A channel system based at 2400 MHz is divided into two banks, primary and secondary is employed. There are 18 channels in each bank and they are paired, such that one channel in the primary bank is associated with one channel in the secondary bank. This allows redundancy in packet transmission if one channel experiences interference. The channel system is chosen from the map of Bluetooth LE data channels but avoids the high-use advertising channels.

Figure 8A:
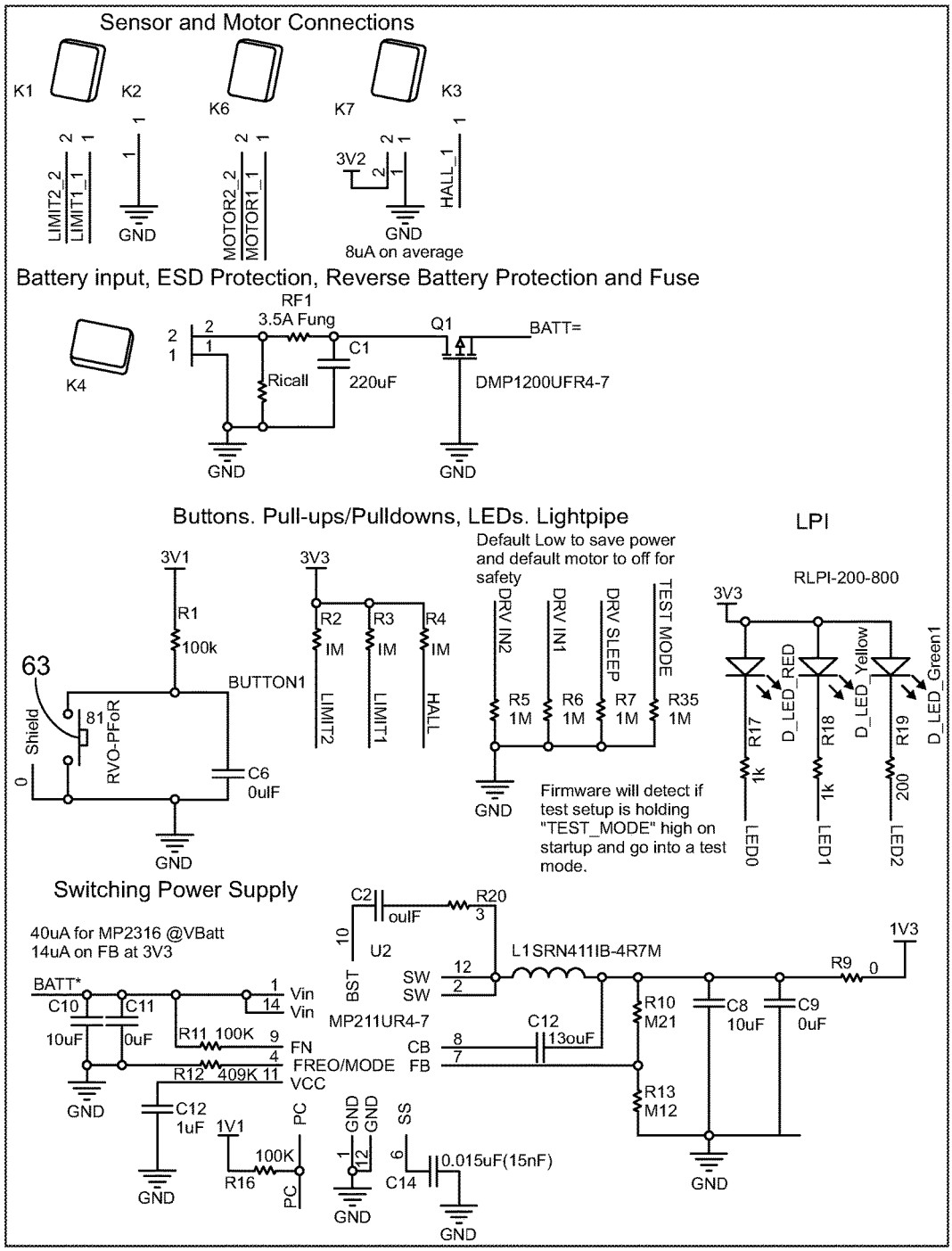
FIGS. 8A and 8B are schematic views of elements of latching mechanism coupled to and adjacent the gate element for latching and unlatching the gate element.

A BLE module at both the remote and the A BLE module at both the remote and the latching mechanism at the gate element, may be provided with either an integrated self-contained processor or IC chipsets, such as widely available micro-controllers including Bluetooth FCC SIG qualified units e.g. Nordic Semiconductor nRF51822 CPU as an integrated radio and generic processing unit. In the present described embodiment of the FIGS. 8A and 8B and FIG. 9 schematics of the gate element latching mechanisms, and the remote controller respectively, the Bluetooth BLE 4.2 Taiyo Yuden™ 802.15.1 smart module EYSGJNZWY was ideal for both the gate mechanism and the remote controllers for wireless communication with low-energy consumption. Although it is the present described embodiment, the architecture of the processing and radio system is not at all limited to that CPU. The Sensor and Motor Connections are provided with Hall Effect magnetic sensors, Limit switches, and Motor or Solenoid drivers operable with the CPU. The Limit Switches K1 and K2 of FIG. 8A are ALPS™ SPVM110100 bi-directional detector switches, and the Hall Sensor K3 is provided by Diodes Incorporated™ AH1807-W-7 which provides Board Mount Hall Effect/Magnetic Sensors Hall Effect Switch 2.5V to 5.5V 24 uW. The Solenoid or Motor Driver U3 of FIG. 8B for motor or solenoid motion control drivers may be provided as Texas Instruments™ DRV8838DSGR power driver circuits. The solenoid or motor 62 as discussed drives the block back and forth along screw 58 into position with Guoling™ DC Gear Motor GA12YN20-5 providing the screw gear micro thread motor miniature DC motor and shaft. As discussed with regard to the controllers, processors, or CPU any equivalently integrated CPU from a variety of sources, e.g., Dialog Semiconductor, Texas Instruments or Atmel could be used interchangeably without modification to the control protocol presented.

Figure 8B:
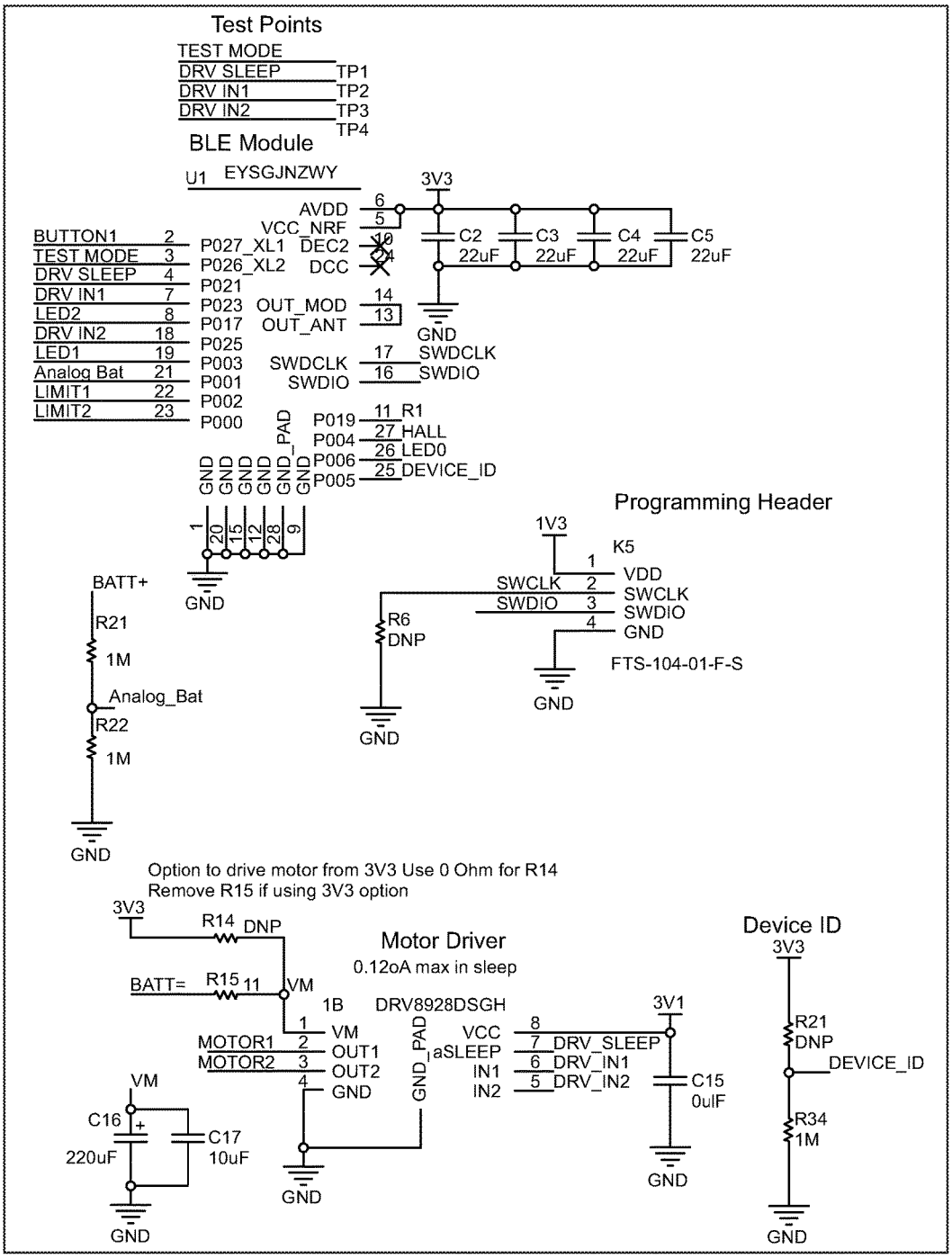

In operation, as seen in FIG. 8B, when the gate is closed, a Bluetooth (BLE) radio frequency trans-receiver at the gate awakens every 333 ms and spends 20 ms listening on its channel from the Primary Bank, and if nothing is heard, 20 ms on its channel from the Secondary Bank. If still nothing is heard then, it returns to sleep. The channel selection is derived from the least significant byte of its random MAC ID code, which is programmed by the chip manufacturer. If a message is received and is intact via its CRC, it is decoded. If the command is "Open" and the MAC ID that follows in the message matches the gate's MAC ID, it commences the open procedure. If either the command or the MAC do not match, the packet is discarded and no action is taken.

In associate mode, the latching mechanism at the gate is programmed by pressing a recessed button in the pawl housing. When the button on the gate is pressed for more than 4 seconds, the gate CPU enters a mode that allows remote buttons to associate with it. In this mode it broadcasts a packet with a command "Associate" and its MAC ID singularly on its channel from the Primary Bank. It does so once every 100 ms, for a duration of 10 seconds. It then returns to Operation mode, listening for command packets on its two channels.

Figure 9:
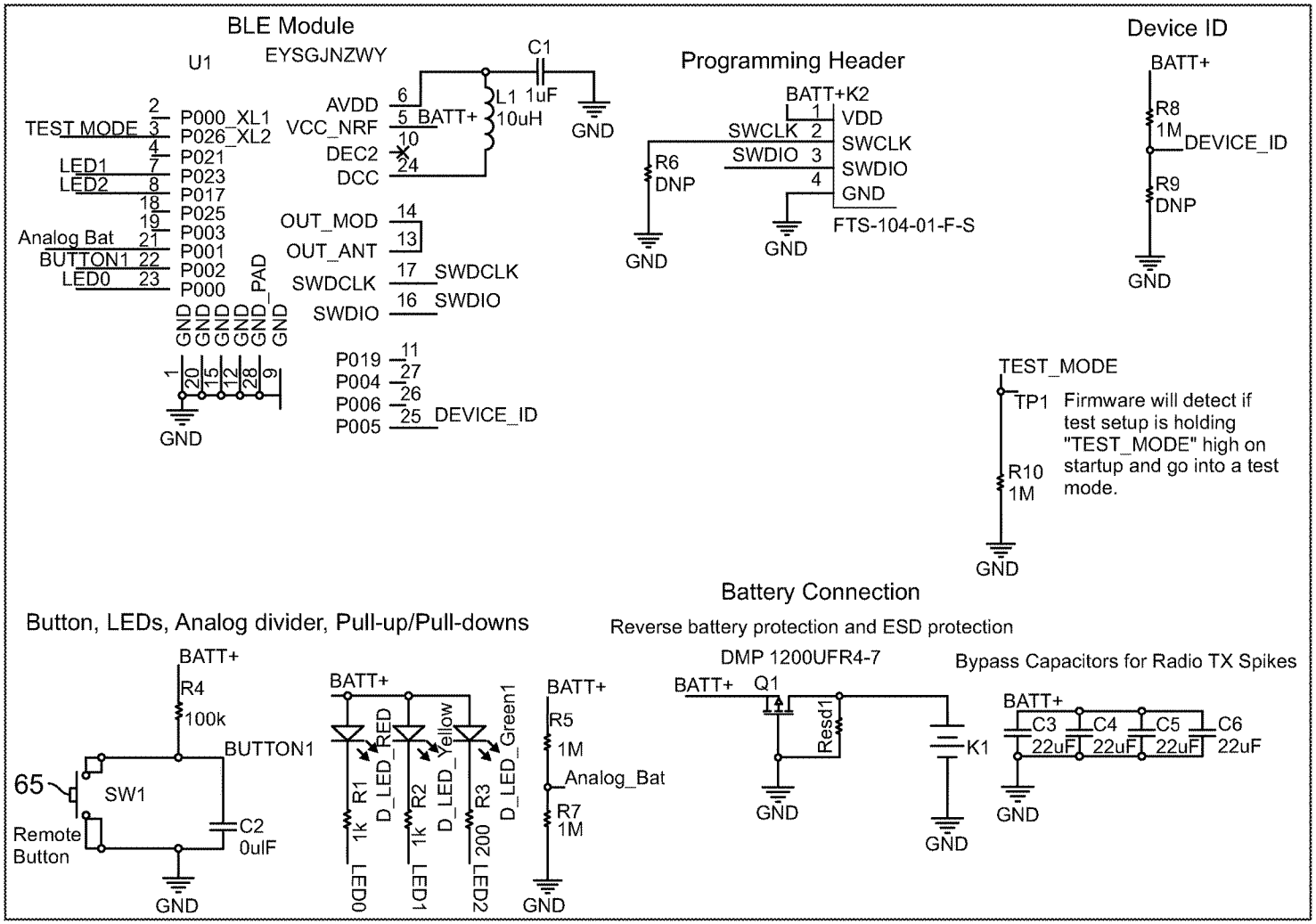
FIG. 9 is a schematic view of hardware of the remote controller.

In operate mode, as seen in FIG. 9, pressing the remote button 65 begins communication with a contained remote Bluetooth (BLE) radio frequency transceiver, and transmission of an "Open" command code and the associated gate MAC ID on the channels in the Primary and Secondary banks. The interval is 200 ms with a random perturbation and the total duration is 2000 ms. This is chosen to maximize intersection with the 10 ms listening durations of the gate. If the remote has yet to be associated with a gate, no radio operation occurs and instead, the red LED blinks quickly.

Figure 6:
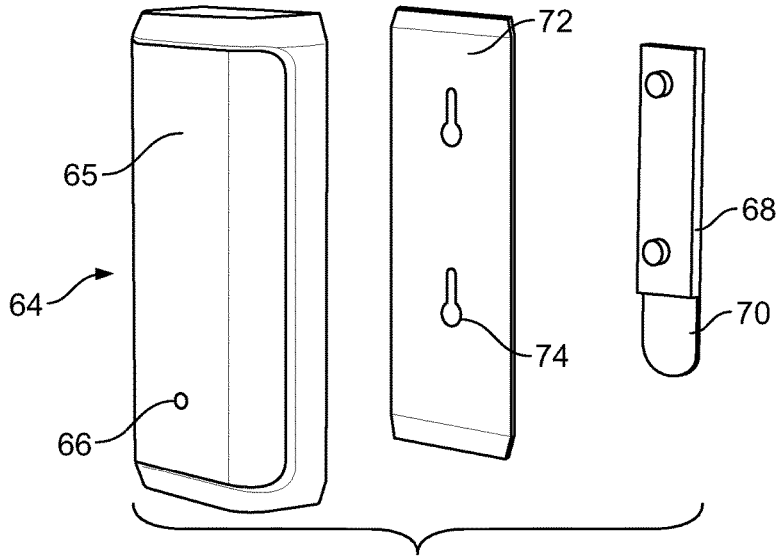
FIG. 6 is an exploded view of a remote controller for actuating the driving mechanism to shift the locking block to unlatch the latching mechanism.

The electronics processing architecture and radio system include a microprocessor with multiple circuit boards are contained within the panel and frame of the safety gate assembly 10. The electronics of FIG. 6 are also represented in schematics, representing the gate electronics, also as seen in FIG. 9, representing the remote control electronics.

The remote control can be programmed in the associate mode when a recessed button on the frame is pressed for more than 4 seconds, the remote CPU enters a mode that allows it to learn the unique MAC ID code of the gate it is to control. In this mode is slowly scans through the bank of Primary channels looking for a valid packet with an "Associate" command inside. When it receives one, it extracts the MAC ID of the gate and saves it into non-volatile memory. Now, the remote is associated with a specific gate and knows what to broadcast when in operate mode. The remote spends 120 ms listening on each channel requiring 2160 ms to cover the entire Primary bank in the worst case. If no valid "Associate" packet is heard the remote returns to its last state.

Bluetooth (BLE) communication allows the remote 64 to be mounted almost anywhere in the vicinity of the safety gate assembly 10, and work with a smart phone, tablet, or the like. The remote is generally rectangular shape with a generally low profile that allows the remote to easily fit in a door jamb or hallway, etc. The simple push button 65 of the remote 64 provides an easy single touch activation of the remote conveniently utilizing a user's fingers, palm of hand, forearm, elbow or shoulder.

The wireless communication between the remote actuator 64 and the motor 62 can be designed specific to each safety gate the remote actuates such that the user has the ability to use as many gates as needed with one remote and, alternatively, employ a specific remote for each safety gate assembly. Additionally wireless BLE communication with smart devices as discussed allow for the ability to reprogram the software behavior of the safety gate, allows the user to receive software updates after the product is installed in the home and allows for product usage information. In the present described embodiment, the remote actuator 64 is powered by a small consumer battery(s) with a battery life of over 6 months and includes a low battery indicator LED 66 or via wireless smart devices to alert a user at least 2 weeks before the end of the life of the battery. Alternatively, a single coin cell battery (ref 2032) can power the remote actuator and have a battery life of 1+ years.

The remote actuator is easily mounted on a wall or door jamb in the vicinity of the safety gate assembly 10, providing easy one touch use with a hand or other body part, etc. for simple and convenient activation of the remote. Additionally, the remote actuator 64 includes an easily mounting bracket 68 employing adhesive tape with a mounting tab 70 for non-destructive mounting and discrete tape release. Further, a battery door 72 with keyhole 74 slot for mounting on the bracket 68 or on nails, further provides for easy and convenient mounting of the remote actuator 64 in a location desired by the user.

Figure 5A:
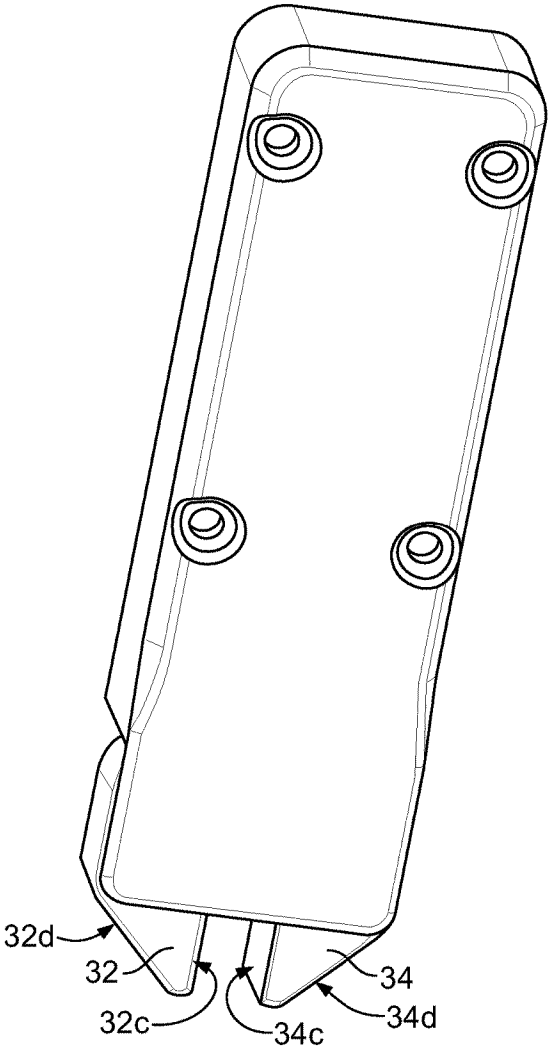

Additionally, a hall effect sensor 76 is disposed at the latching mechanism 14, and in the present described embodiment, the sensor 76 is disposed adjacent the motor in the pawl housing, and tracks if the gate element 12 is open or closed as seen in FIG. 5A with reference to 3, 4A & 4B. The sensor 76 alerts the remote actuator 64 as to the open or closed status of the gate element 12.

In use, a locked latching mechanism 14 includes the locking block engaged with the pivot end of the pawls and the gate element 12 closed with the pivoting lever 30 captured between pawls 32 and 34. The gate element 12 is unlatched and opened when desired by the user with either a press of the remote actuator button 65 or by shifting the manual release handle 44. Activating the remote actuator with a simple press of the button 65 will wirelessly signal the motor to travel away from the pivot ends of the pawls allowing the pawls to pivot and release the pivoting lever as the user pushes or pulls the gate element open in either direction. The pawls are spring biased to pivot back toward each other after the lever has pushed past one of the pawls, such that the pawl that is pushed away will be spring biased back toward the opposite pawl.

The angled surfaces 32*d* and 34*d*, of pawls 32 and 34, respectively, direct the lever back to a captured position between the pawls when the gate element is pivoted toward a closed position in a slamming fashion. In the present described embodiment, the remote actuator 64 wirelessly signals the motor to drive the block back into a locking position, butting the lock against the pawls, immediately subsequent to the gate element opening, such that when the gate element swings closed after the user has passed through, the locked pawls will easily capture the lever as the gate element is closed in a slamming fashion, to swiftly and automatically lock the latching mechanism with the closed gate.

Alternatively, the closed gate with the locked latching mechanism can be released manually when either desired by the user on a day to day basis, or when a manual override is needed such when the remote battery or motor battery die. The captured pivoting lever can be spring released for easy door pass through by shifting the manual release handle. Applying a lateral force followed by an upward horizontal force to the manual release handle shifts the actuator leg 42 toward the second end 30*b* of the pivoting lever and lifts protruding peg 46 to pivot the lever down from a horizontal position and out from capture between the pawls allowing the user to swing open the gate element in either direction. The pivoting lever is spring biased to the horizontal position and swiftly and automatically pops back to the horizontal position when the user releases the manual release handle, allowing the gate element to slam closed and lock between the locked pawls after the user has passed through the open gate, as described above.

Figure 10A:
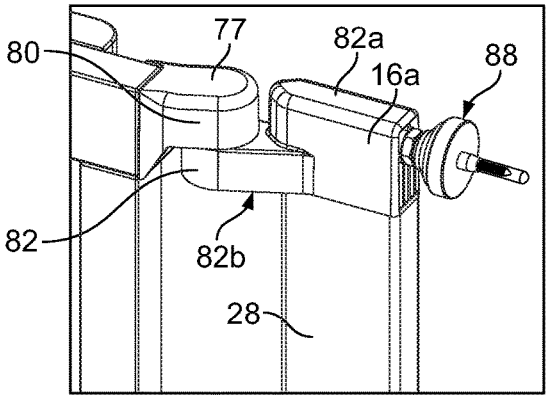
Figure 10B:
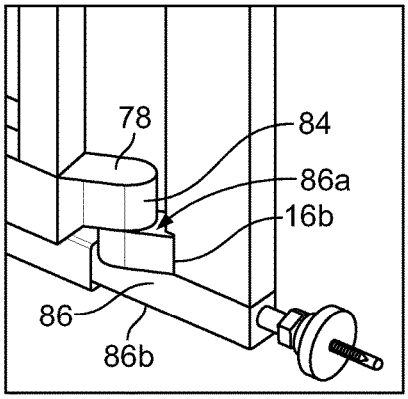
FIG. 10B is illustrating a swivel hinge at a second attachment point on the frame element.

In the present described embodiment, the secured end 12*b* of the gate element 12 is secured to the frame element 16 at first and second attachment points 16*a* and 16*b* along the frame, as seen in FIGS. 10A and 10B. First and second swivel hinges, 77 and 78, respectively, are spaced apart from one another and disposed at first and second attachment points, 16*a* and 16*b*, respectively. First and second swivel hinges are coupled to the frame assembly at first and second attachment points and couple the secured end of the gate element to the frame assembly, and spring elements such as an internal torsion spring may be employed in the hinges with either FIGS. 10A and/or 10B sections to enable auto-closing behavior to automatically swing the gate closed.

Each of the first and second swivel hinges, 77 and 78, respectively, includes a gate attachment portion and a frame attachment portion, and at least one gliding surface that pivots about the attachment point at the frame for swinging the gate element out and away from the frame element as the gate pivots to the open position. As seen in FIG. 10A, swivel hinge 77 includes a gate attachment portion 80 and a frame attachment portion 82. Frame attachment portion 82 includes first and second gliding surfaces, 82*a* and 82*b*, respectively, which glide along the frame element at the attachment point 16*a* as the gate element pivots open, to the extend open the gate element beyond a 90 degree angle with respect to the frame. Additionally, the gate attachment portion 80 also glides along the first gliding surface 82*a* as it pivots the gate element open with respect to the frame, to further extend the open gate beyond a 90 degree angle with respect to the frame.

Likewise, as seen in FIG. 10B, swivel hinge 78 includes a gate attachment portion 84 and a frame attachment portion 86. Frame attachment portion 86 includes first and second gliding surfaces, 86*a* and 86*b*, respectively, which glide along the frame element at the attachment point 16*b* as the gate element pivots open, to the extend open the gate element beyond a 90 degree angle with respect to the frame. Additionally, the gate attachment portion 84 also glides along the first gliding surface 86*a* as it pivots the gate element open with respect to the frame, to further extend the open gate beyond a 90 degree angle with respect to the frame.

The swivel hinges 77 and 78 cooperate to extend open the gate element 12 beyond 90 degrees with respect to the frame element 16 for easy pass through the doorway/passage way as well as to allow the gate element to stay open, without user assistance, for as long as desired by the user. Additionally, the swivel hinges allow for a natural swing auto-close of the gate element 12 to simply yet uniquely re-lock the gate element as it is closed by the user in a slamming fashion.

Figure 11A:
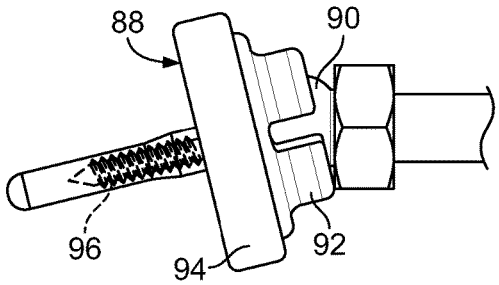
FIGS. 11A and 11B are illustrating a pivot pad cooperating with a ball hinge coupled to the frame element, with FIG. 8A illustrating the ball hinge lightly swiveled within the pivot pad.
Figure 11B:
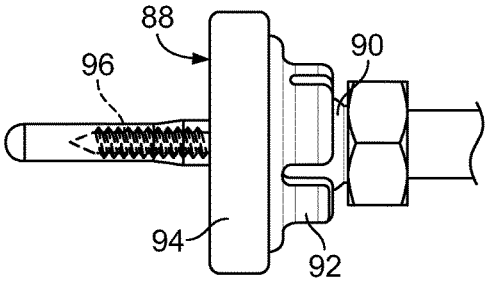

The frame element 16 is secured to the doorway/passage way either with a tension mounting or, in the present described embodiment, by employing a pivoting pad 88 to cooperate with a ball hinge 90 to create a ball and socket type connection which is anchored to the doorway/passage way, as seen in FIGS. 11A and 11B, and provide the user flexibility in fine tuning the attachment of the frame element to the doorway/passageway. The pivoting pad 88 may include a socket portion 92 and a pad portion 94 which is affixed to a mounting screw 96.

Figure 12:
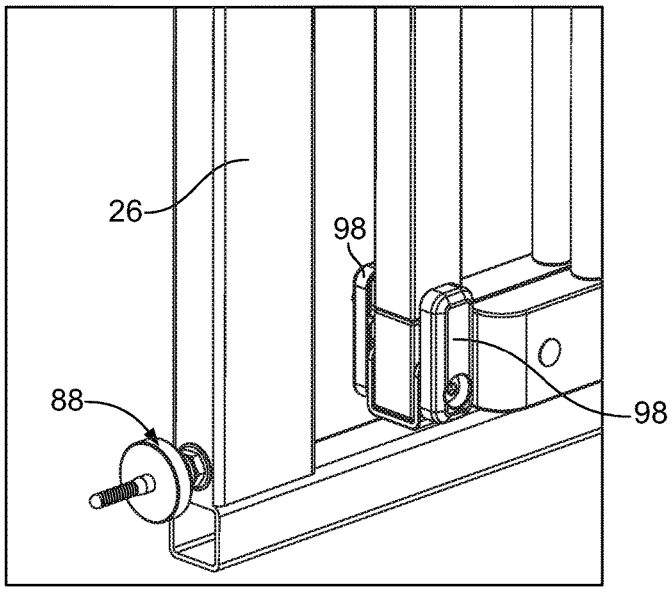
FIG. 12 is illustrating a stop for limiting the direction in which the gate element is pivoted to the open position.

Each of the left and right leg portions 26 and 28, respectively, of the frame element is affixed to a ball hinge 90 that cooperates with a pivot pad 88 and secures the frame element to the doorway/passage way, as seen in FIGS. 10A and 12, it will be appreciated that various portion 92 or pad portion 94 or other arrangements may be employed. Each ball hinge 90 is captured within the socket portion 92 of the pivot pad 88, as seen in FIGS. 11A and 11B, with the ball hinge 90 swiveling lightly within the socket 92, as seen in FIG. 11A, to allow for a plumb fit of the frame element to a wall or door jamb that is less than plumb.

A stop 98, as seen in FIG. 12, is coupled to one of the gate element 12 or frame element 16 for limiting the direction in which the gate element can be pivoted or swung open as desired by the user. In the present described embodiment, a stop 98 is coupled to opposite sides of the gate element adjacent the frame element and can be pivoted to lay parallel with the frame element preventing the gate element from opening a direction away from the stop and allowing the gate element to only open in the opposite direction.

From the foregoing, it can be seen that there has been provided a pivoting gate element secured to a doorway and/or passageway and employing a dual actuator latching mechanism including simple yet unique pivoting lever and pawl mechanism for remote and manual latch release to free the gate to swing to an open position and automatic relocking of the gate when swung to the closed position. While a particular embodiment of the present invention has been shown and described, it will be obvious to those skilled in the art that changes and modifications may be made without departing from the invention in its broader aspects. Therefore, the aim in the claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. A safety gate assembly, comprising:

a pivoting gate element including a secured end and an open end, pivoting at the secured end between an open and a closed position;

a pivoting lever disposed at the open end of the gate including a first end and second end;

two or more pawls disposed adjacent the pivoting lever, the pawls include a pivot end and a free end and pivot away from and toward each other capturing the pivoting lever between the pawls at the free end to latch the pivoting gate in the closed position;

a piston driven locking block disposed adjacent the pawls at the pivot end;

a driving mechanism in mechanical communication with the block driving the block back and forth and into a locking position when the block is driven between the pawls at the pivot end;

a remote actuator in wireless communication with the driving mechanism, signaling the driving mechanism to shift the block away from the pivot ends of the pawls allowing the pawls to pivot away from each other at the pawl free ends releasing the pivoting lever from between the pawls to unlatch the gate to the open position;

a manual actuator leg disposed adjacent the second end of the lever; and a manual release handle coupled to the actuator leg, an upward force of the handle elevates the second end of the lever releasing the first end of the lever from between the pawls to unlatch the gate to the open position.

2. The gate assembly according to claim 1, wherein the driving mechanism includes a system selected from the group consisting of a solenoid system and a motor system operable with the piston for driving the locking block disposed adjacent the pawls at the pivot end, with the driving mechanism actuating the block driving the block back and forth and into a locking position.

3. The gate assembly according to claim 1, further comprising a biasing element disposed adjacent the pawls biasing the free end of the pawls to pivot toward each other.

4. The gate assembly according to claim 3, wherein each of the pawls includes an angled surface for directing the lever to a captured position between the biased pawls when the gate assembly is pivoted toward the closed position in a slamming fashion.

5. The gate assembly according to claim 1, further comprising a spring element coupled to the pivoting lever for biasing the first end of the lever to generally horizontal position and captured position between the free ends of the pawls when the gate element is closed.

6. The gate assembly according to claim 5, wherein the manual release handle unlatches the gate element through a lateral force shifting the handle toward the gate followed by a vertical upward force shifting the handle up and away from the gate.

7. The gate assembly according to claim 1, further comprising a frame assembly including right and left L shaped elements secured together and forming a u shaped frame assembly supporting the gate element there between.

8. The gate assembly according to claim 7, further comprising a first and second swivel hinge spaced apart from one another and coupled to the frame assembly at first and second attachment points coupling the secured end of the gate element to the frame assembly, each swivel hinge includes at least one gliding surface that pivots about the attachment point at the frame swinging the gate out away from the frame as the gate pivots to the open position.

9. The gate assembly according to claim 8, wherein the gate element pivots open with respect to the frame element beyond a 90 degree angle.

10. The gate assembly according to claim 1, further comprising active electronics adjacent the driving mechanism and the gate element for sensing and processing the open and closed position of the gate element.

11. A safety gate assembly, comprising:

a pivoting gate element including a secured end and an open end, pivoting at the secured end between an open and a closed position;

a pivoting lever disposed at the open end of the gate including a first end and second end;

two matching pawls disposed adjacent the pivoting lever, the pawls include a pivot end and a free end and pivot away from and toward each other capturing the pivoting lever between the pawls at the free end to latch the pivoting gate in the closed position;

a screw driven locking block disposed adjacent the pawls at the pivot end;

a driving mechanism in mechanical communication with the block driving the block back and forth and into a locking position when the block is driven between the pawls at the pivot end, preventing the pawls from pivoting away from each other at the free end latching the pivoting lever between the pawls;

a remote actuator in wireless communication with the driving mechanism, signaling the driving mechanism to shift the block away from the pivot ends of the pawls allowing the pawls to pivot away from each other at the pawl free ends releasing the pivoting lever from between the pawls to unlatch the gate to the open position;

a manual actuator leg disposed adjacent the second end of the lever; and a manual release handle coupled to the actuator leg, an upward force of the handle elevates the second end of the lever releasing the first end of the lever from between the pawls to unlatch the gate to the open position.

12. The gate assembly according to claim 11, further comprising a biasing element disposed adjacent the pawls biasing the free end of the pawls to pivot toward each other.

13. The gate assembly according to claim 12, wherein each of the pawls includes an angled surface for directing the lever to a captured position between the biased pawls when the gate assembly is pivoted toward the closed position in a slamming fashion.

14. The gate assembly according to claim 11, further comprising a spring element coupled to the pivoting lever for biasing the first end of the lever to generally horizontal position and captured position between the free ends of the two matching pawls when the gate element is closed.

15. The gate assembly according to claim 14, wherein the manual release handle unlatches the gate element through a lateral force shifting the handle toward the gate followed by a vertical upward force shifting the handle up and away from the gate.

16. The gate assembly according to claim 11, further comprising a frame assembly including right and left L shaped elements secured together and forming a u shaped frame assembly supporting the gate element there between.

17. The gate assembly according to claim 16, further comprising a first and second swivel hinge spaced apart from one another and coupled to the frame assembly at first and second attachment points coupling the secured end of the gate element to the frame assembly, each swivel hinge includes at least one gliding surface that pivots about the attachment point at the frame swinging the gate out away from the frame as the gate pivots to the open position.

18. A safety gate method, comprising the steps of:

providing a pivoting gate element with a secured end and an open end;

pivoting the pivoting gate element at the secured end between an open and a closed position;

disposing a pivoting lever having a first end and second end at the open end of the gate;

providing two or more pawls disposed respectively adjacent the pivoting lever, the pawls including a pivot end and a free end and pivot away from and toward each other capturing the pivoting lever between the pawls at the free end to latch the pivoting gate in the closed position;

driving a locking block adjacent the pawls disposed at the pivot end in mechanical communication for moving the locking block back and forth and into a locking position when the block is driven between the pawls at the pivot end;

preventing the pawls from pivoting away from each other at the free end latching the pivoting lever between the pawls;

providing a remote actuator in wireless communication with the driving mechanism, signaling the driving mechanism to shift the block away from the pivot ends of the pawls allowing the pawls to pivot away from each other at the pawl free ends releasing the pivoting lever from between the pawls to unlatch the gate to the open position;

providing a manual actuator leg disposed adjacent the second end of the lever; and providing a manual release handle coupled to the actuator leg, an upward force of the handle elevates the second end of the lever releasing the first end of the lever from between the pawls to unlatch the gate to the open position.

19. The safety gate method according to claim 18, further comprising the step of providing a spring element coupled to the pivoting lever for biasing the first end of the lever to generally horizontal position and captured position between the free ends of the two or more pawls when the gate element is closed, wherein the manual release handle unlatches the gate element through a lateral force shifting the handle toward the gate followed by a vertical upward force shifting the handle up and away from the gate.

20. The safety gate method according to claim 18, further comprising the step of providing active electronics adjacent the driving mechanism and the gate element for sensing and processing the open and closed position of the gate element.

* * * * *